US005643163A

United States Patent [19]

Chen

[11] Patent Number: 5,643,163

[45] Date of Patent: Jul. 1, 1997

[54] GYMNASTIC APPARATUS

[76] Inventor: David Chen, P.O. Box 63-150, Taichung, Taiwan

[21] Appl. No.: 645,745

[22] Filed: May 14, 1996

[51] Int. Cl.[6] ..... A63B 23/00

[52] U.S. Cl. ..... 482/142; 482/907

[58] Field of Search ..... 482/142; 297/16.1, 297/16.2, 55, 452.22; 4/460, 479, 480, 483, 578.1, 579

[56] References Cited

U.S. PATENT DOCUMENTS

| | | | |
|---|---|---|---|
| 2,877,829 | 3/1959 | Ferar et al. | 297/55 |
| 5,095,556 | 3/1992 | Franey | 4/460 |
| 5,526,537 | 6/1996 | Conrad | 4/483 |

*Primary Examiner*—Richard J. Apley
*Assistant Examiner*—William LaMarca

[57] ABSTRACT

A gymnastic apparatus which includes a waist stand made from a substantially U-shaped frame rod, the waist stand having two parallel end rod sections, and a transverse intermediate rod section joined between the parallel end rod sections; a shoulder rack pivoted to the waist stand and connected between the end rod sections for supporting the player's shoulders, the shoulder rack having a shoulder cushion at the top and two handgrips bilaterally disposed in front of the shoulder cushion, the shoulder cushion having two bearing portions for supporting the player's shoulders and defining a mouth for the passing of the player's head; and a back support pivoted to the waist stand to support the waist stand in a sloping position and to support the shoulder cushion in a horizontal position.

6 Claims, 4 Drawing Sheets

GYMNASTIC APPARATUS

BACKGROUND OF THE INVENTION

The present invention relates to exercising apparatus, and relates more particularly to a gymnastic apparatus specifically designed for exercising gymnastics.

A variety of exercising apparatus, such as step machines, rowing machines, chest weights, etc., have been disclosed for exercising the muscles of different parts of the body, and have appeared on the market. These exercising apparatus are commonly heavy, and suitable for indoor use only. Furthermore, using conventional exercising apparatus cannot exercise the whole body at a time. It is known that swimming and gymnastics are simple and effective ways to exercise the body. However, swimming can only be performed in a swimming pool.

SUMMARY OF THE INVENTION

It is one object of the present invention to provide a gymnastic apparatus which is particularly designed for practicing gymnastics. It is another object of the present invention to provide a gymnastic apparatus which is practical for exercising the gymnastics of headstand and back-bend to help blood circulation. It is still another object of the present invention to provide a gymnastic apparatus which is practical for use as a teaching aid in practicing gymnastics. It is still another object of the present invention to provide a gymnastic apparatus which is collapsible and portable.

To achieve the aforesaid and other objects of the present invention, there is provided a gymnastic apparatus comprised of a waist stand made from a substantially U-shaped frame rod, the waist stand having two parallel end rod sections, and a transverse intermediate rod section joined between the parallel end rod sections; a shoulder rack pivoted to the waist stand and connected between the end rod sections for supporting the player's shoulders, the shoulder rack comprising a shoulder cushion at the top and two handgrips bilaterally disposed in front of the shoulder cushion, the shoulder cushion having two bearing portions for supporting the player's shoulders and defining a mouth for the passing of the player's head; and a back support pivoted to the waist stand to support the waist stand in a sloping position and to support the shoulder cushion in a horizontal position.

DETAILED DESCRIPTION OF THE PREFERRED EMBODIMENT

Figure 1:
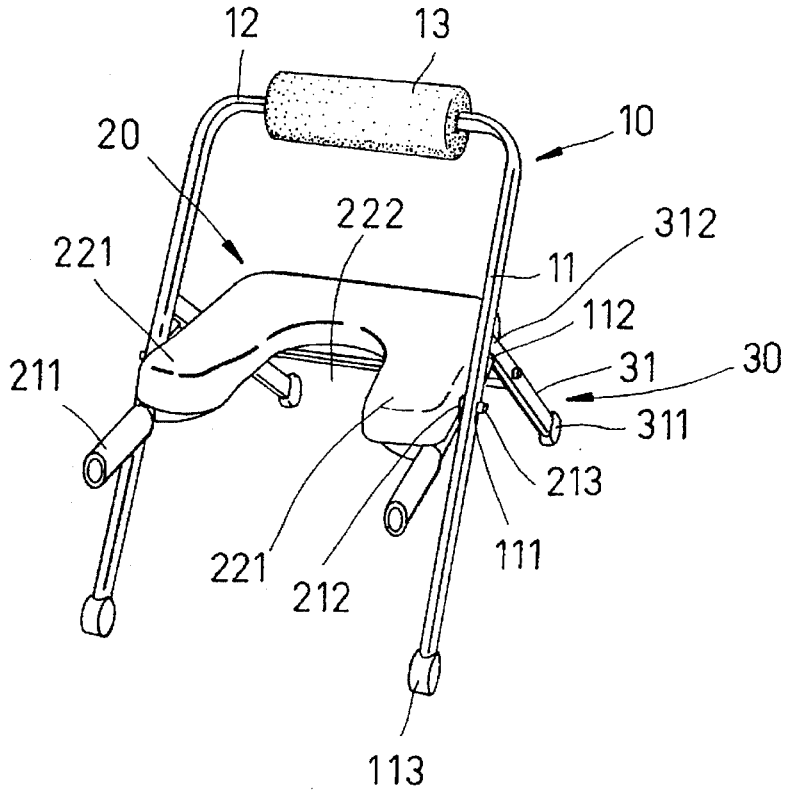
FIG. 1 is an elevational view of the present invention showing the gymnastic apparatus thereof set into the operative position.
Figure 2:
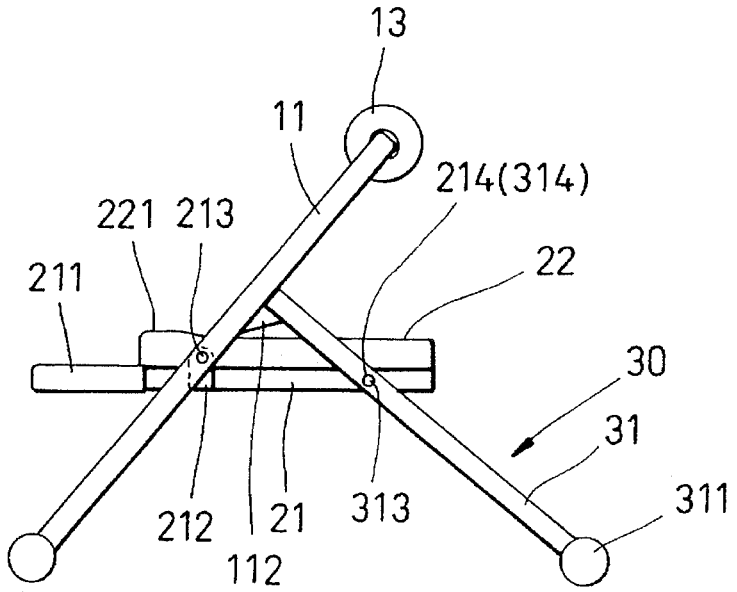
FIG. 2 is a side plain view of FIG. 1.

Referring to FIGS. 1 and 2, a gymnastic apparatus in accordance with the present invention is generally comprised of a waist stand 10, a shoulder rack 20, and a back support 30. The waist stand 10 is made from a substantially U-shaped frame rod comprised of two parallel end rod sections 11, and a transverse intermediate rod section 12 joined between the parallel end rod sections 11. The transverse intermediate rod section 12 is mounted within a soft barrel 13. The axial length of the soft barrel 13 is preferably not shorter than the waistline. Each of the end rod sections 11 has a top end connected to one end of the transverse intermediate rod section 12, a pivot hole 111 in the middle, a triangular projection 112 adjacent to the pivot hole 111, and a bottom end fixedly mounted with a foot pad 113. The shoulder rack 20 is comprised of a substantially U-shaped mounting rod 21, and a shoulder cushion 22 mounted on the U-shaped mounting rod 21 at the top side. The U-shaped mounting rod 21 has two upward lugs 212 bilaterally disposed in the middle and respectively pivoted to the pivot holes 111 of the end rod sections 11 of the waist stand 10 by a respective pivot 213, two handgrips 211 at the opposite ends thereof, and two pivot holes 214 bilaterally disposed at a back side remote from the handgrips 211. The shoulder cushion 22 is fixedly mounted on the mounting rod 21 at the top side, comprised of two bearing portions 221 for supporting the user's shoulders. The bearing portions 221 define a mouth 222 adapted for the passing of the user's head. The back support 30 is a substantially H-shaped supporting frame comprised of two parallel supporting rods 31. The parallel supporting rods 31 have a respective bottom end fixedly mounted with a foot pad 311, a respective top end fixedly mounted with a short projecting rod 312 adapted for stopping at the triangular projections 112 of the waist stand 10, and a respective pivot hole 313 disposed near the top end and respectively pivotably connected to the pivot holes 214 of the mounting rod 21 by a respective pivot 314. When assembled, the waist stand 10 and the back support 30 are respectively pivoted to the shoulder rack 20 and turned about the respective pivots 213, 314, and the short projecting rods 312 of the back support 30 are stopped at the triangular projections 112 of the waist stand 10. Therefore, the waist stand 10 and the back support 30 form a firm stand having a substantially triangular profile to support the shoulder rack 20 firmly in a horizontal position.

Figure 3:
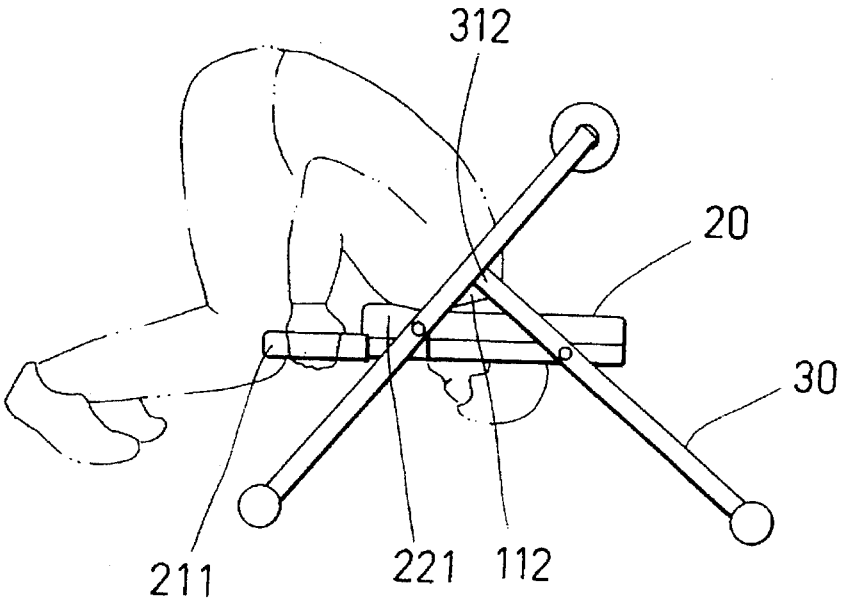
FIG. 3 is an applied view of the present invention showing the practice of the gymnastics of headstand (Step I)
Figure 4:
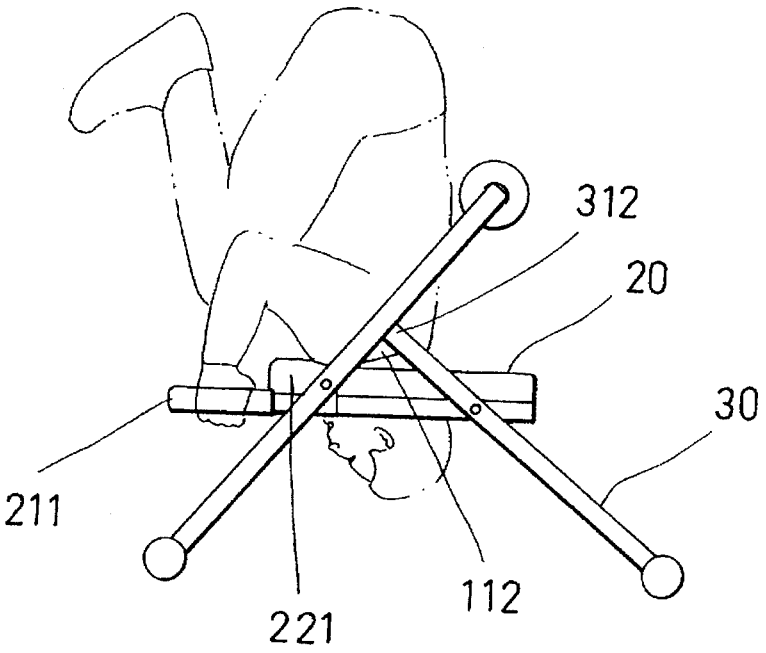
FIG. 4 is an applied view of the present invention showing the practice of the gymnastics of headstand (Step II)
Figure 5:
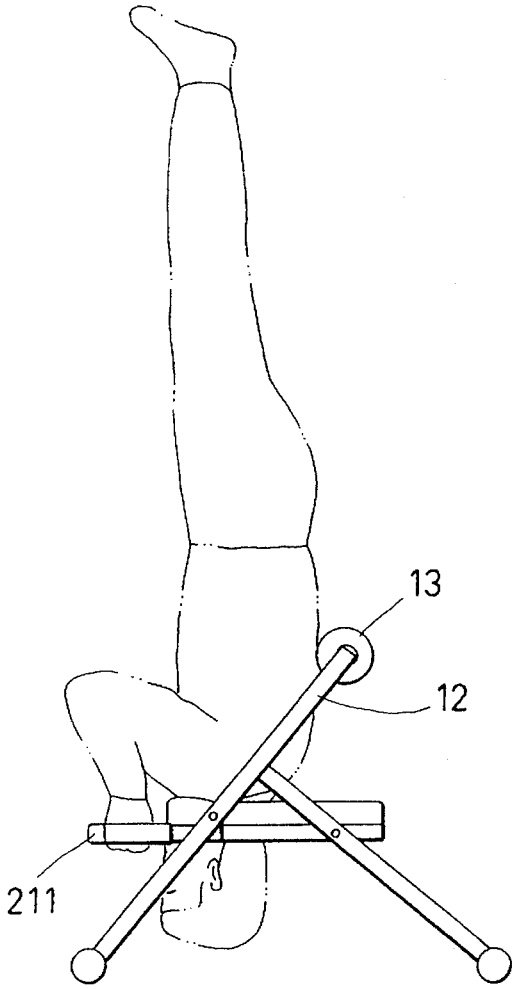
FIG. 5 is an applied view of the present invention showing the practice of the gymnastics of headstand (Step III)

FIGS. 3, 4, and 5 show an application of the present invention in practicing the gymnastics of headstand. When performing the gymnastics of headstand, the handgrips 211 are held positively in the hands, then the head is bent downwards and inserted into the mouth 222 of the shoulder rack 20, permitting the shoulders to be supported on the bearing portions 221 of shoulder cushion 22 of the shoulder rack 20 (see FIG. 3), then the legs are lifted from the ground and the trunk is maintained vertical, permitting the thighs to be closely attached to the chest (see FIG. 4), and then the legs are lifted, permitting the legs and the body to be maintained in a line and the back to be supported on the soft barrel 13 (see FIG. 5). When the legs are lifted from the ground and suspending in the air in a vertical position, and the weight of the body is supported on the bearing portions 221 of the shoulder rack 20 and the soft barrel 13, therefore the muscles of the legs are relaxed, and the blood is circulated through the head at a fast speed. A certain length of time after the performance of the posture of headstand, the legs are lowered from the position shown in FIG. 5 to the position shown in FIG. 4, and then the trunk is bending downwards to move the legs from the position shown in FIG. 4 to the position shown in FIG. 3. Repeating this performance helps one exercise the way of balancing the body in headstand.

Figure 6:
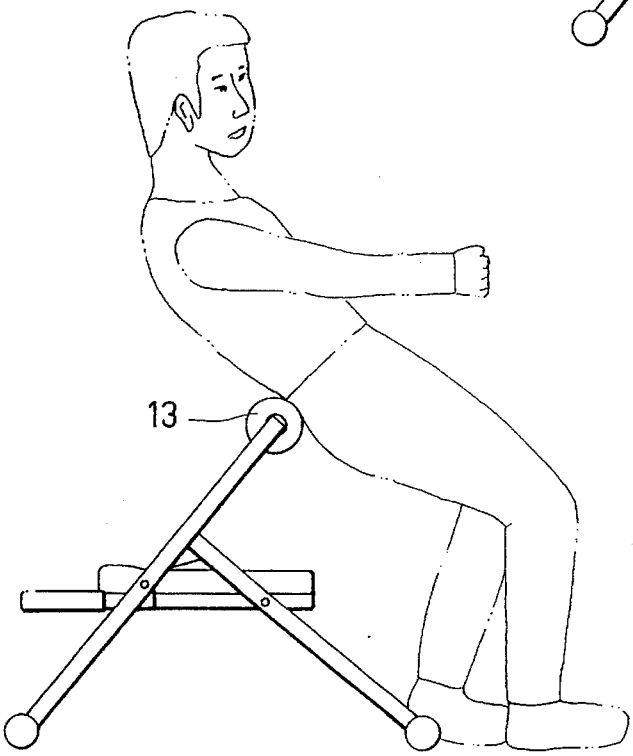
FIG. 6 is another applied view of the present invention showing the practice of the gymnastics of back-bend (Step I)
Figure 7:
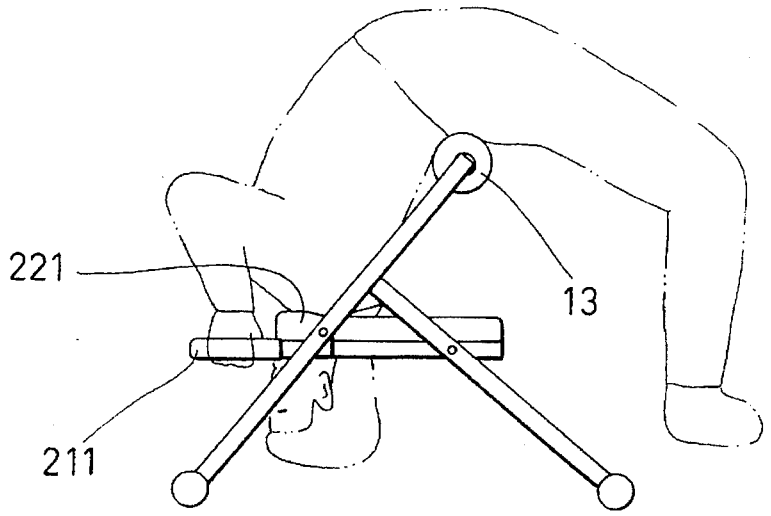
FIG. 7 is another applied view of the present invention showing the practice of the gymnastics of back-bend (Step II)

FIGS. 6 and 7 show another application of the present invention in practicing the gymnastics of back-bend. When performing the gymnastics of back-bend, the back of the waist is lied on the soft barrel 13 with the lower parts of the legs maintained in straight and the upper parts of the legs turned slightly backwards (see FIG. 6), and then the trunk is bent backwards at a slow speed, permitting the hands to grasp the handgrips 211 and the head to be inserted into the mouth 222, and therefore the muscles of the back and the waist are trained.

Figure 8:
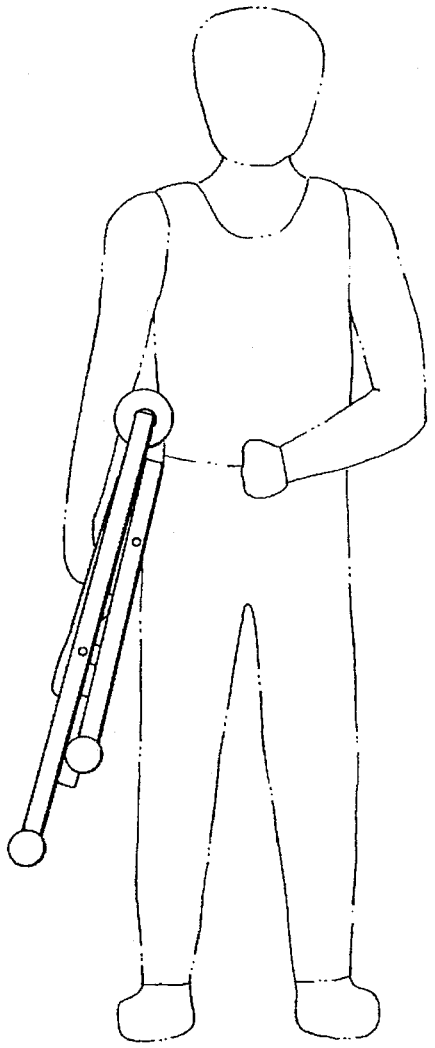
FIG. 8 shows the gymnastic apparatus of the present invention collapsed and carried by hand.

Referring to FIG. 8 and FIG. 2 again, when not in use, the back side of the shoulder rack 20 is turned upwards, permitting the waist stand 10 and the back support 30 to be turned about the respective pivots 213, 314 and closely attached to each other.

While only one embodiment of the present invention has been shown and described, it will be understood that various modifications and changes could be made without departing from the spirit and scope of the invention disclosed.

What the invention claimed is:

1. A gymnastic apparatus comprising:

a waist stand made from a substantially U-shaped frame rod, said waist stand comprising two parallel end rod sections each having a triangular projection, and a transverse intermediate rod section joined between said parallel end rod sections;

a shoulder rack pivoted to said waist stand and connected between said end rod sections for supporting the player's shoulders, said shoulder rack comprising a shoulder cushion at a top side thereof and two handgrips bilaterally disposed in front of said shoulder cushion and substantially aligned with a horizontal plane formed by said shoulder rack, said shoulder cushion having two bearing portions for supporting the player's shoulders and defining a mouth for the passing of the player's head; and a back support pivoted to said waist stand to support said waist stand in a sloping position and to support said shoulder cushion in a horizontal position.

2. The gymnastic apparatus of claim 1 wherein said waist stand further comprises a soft barrel mounted around said transverse intermediate rod section, the axial length of said soft barrel being longer than the player's waistline.

3. The gymnastic apparatus of claim 1 wherein said waist stand has two pivot holes respectively disposed in said end rod sections in the middle; said shoulder rack has two lugs at two opposite sides respectively pivoted to the pivot holes of the end rod sections of said waist stand by a respective pivot.

4. The gymnastic apparatus of claim 1 wherein said back support comprises two supporting rods connected in parallel, said supporting rods having a respective top end fixedly mounted with a short projecting rod adapted for stopping at respective triangular projection on said waist stand, and a respective pivot hole spaced from the respective top end and respectively pivotably connected to respective pivot holes at two opposite sides of said shoulder rack by a respective pivot.

5. The gymnastic apparatus of claim 1 wherein the end rod sections of said waist stand have a respective bottom end fixedly mounted with a foot pad; the supporting rods of said back support have a respective bottom end fixedly mounted with a foot pad.

6. The gymnastic apparatus of claim 1 wherein said waist stand further comprises two triangular projections respectively raised from said end rod sections and adapted for supporting on said back support at the top.

* * * * *